US008986167B2

(12) United States Patent
Olsen

(10) Patent No.: US 8,986,167 B2
(45) Date of Patent: Mar. 24, 2015

(54) TRAINING APPARATUS IMITATING CROSS-COUNTRY SKIING

(75) Inventor: Jonas Thor Olsen, Holte (DK)

(73) Assignee: Thoraxtrainer Company ApS, Holte (DK)

( * ) Notice: Subject to any disclaimer, the term of this patent is extended or adjusted under 35 U.S.C. 154(b) by 248 days.

(21) Appl. No.: 13/126,483

(22) PCT Filed: Oct. 29, 2009

(86) PCT No.: PCT/DK2009/050284

§ 371 (c)(1),
(2), (4) Date: Aug. 24, 2011

(87) PCT Pub. No.: WO2010/048963

PCT Pub. Date: May 6, 2010

(65) Prior Publication Data

US 2011/0300996 A1 Dec. 8, 2011

(30) Foreign Application Priority Data

Oct. 29, 2008 (DK) ..... 2008 01487

(51) Int. Cl.

*A63B 22/00* (2006.01)
*A63B 69/18* (2006.01)
*A63B 21/00* (2006.01)
(Continued)

(52) U.S. Cl.

CPC ..... *A63B 69/182* (2013.01); *A63B 21/152* (2013.01); *A63B 21/154* (2013.01); *A63B 23/1263* (2013.01); *A63B 22/203* (2013.01);
(Continued)

(58) Field of Classification Search

USPC ..... 482/51–52, 57, 62, 70–73, 114–116, 482/900

See application file for complete search history.

(56) References Cited

U.S. PATENT DOCUMENTS 3,475,021 A 10/1909 Ruegsegger
4,434,981 A 3/1984 Norton
(Continued)

FOREIGN PATENT DOCUMENTS

AT 387 722 3/1989
DE 10 2005 010202 11/2005
(Continued)

OTHER PUBLICATIONS

Mygind, Praestationsevne og fysiologiske krav i langrend: en sammenlignende analyse af dansk og international langrendselite, 1994, pp. 1-151.

(Continued)

*Primary Examiner* — Loan H Thanh
*Assistant Examiner* — Jennifer M Deichl
(74) *Attorney, Agent, or Firm* — Gifford, Krass, Sprinkle, Anderson & Citkowski, P.C.; Douglas L. Wathen

(57) ABSTRACT

The present invention relates to an apparatus for exercising the human body comprising a stiff frame accommodating at least two guide tracks and at least one carriage in each guide track, at least one resistance unit, preferably attached to the frame, and for each carriage: a substantially inelastic cord drive system connecting said carriage with said at least one resistance unit, and an elastic cord drive system connecting the substantially inelastic cord drive system with the frame. Specific use of the apparatus according to the invention imitates the pattern of movements in cross-country skiing.

25 Claims, 8 Drawing Sheets

Figure 1:
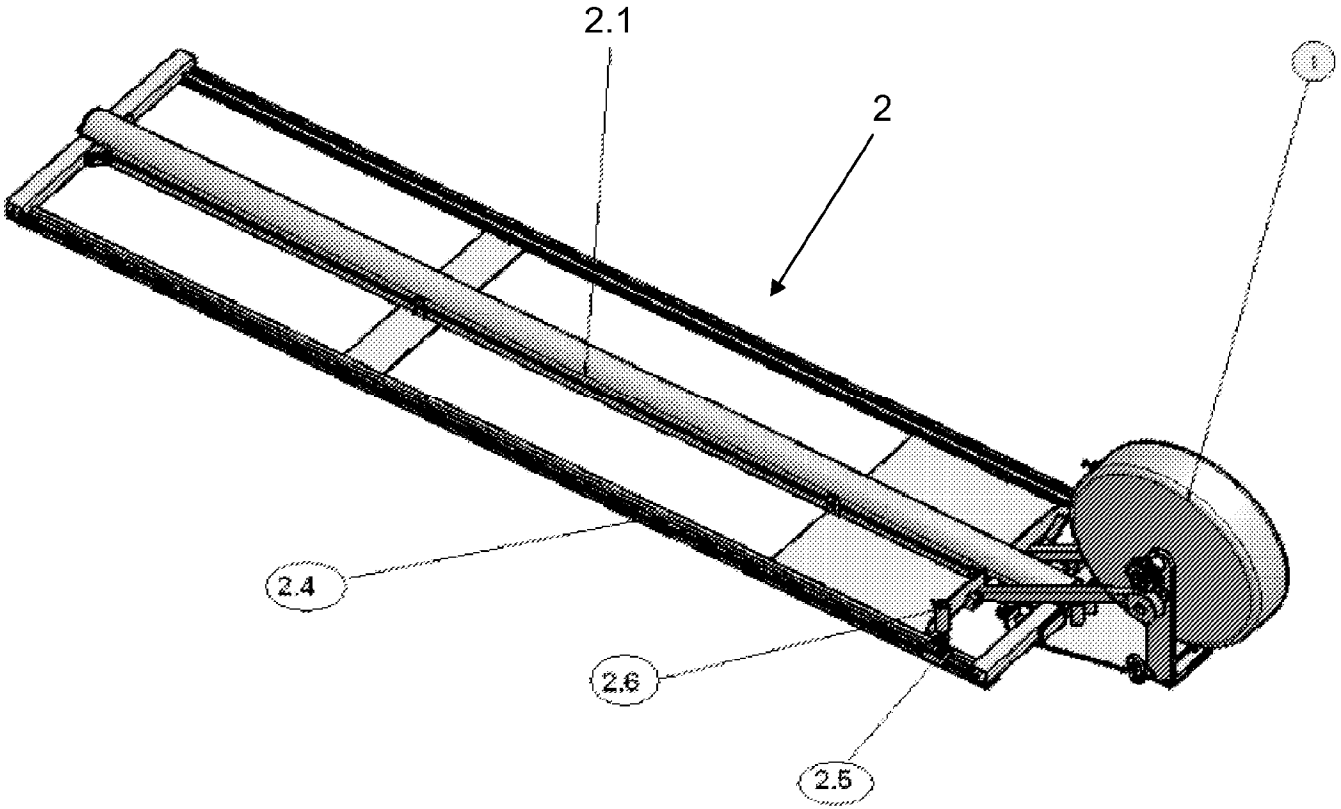

(51) Int. Cl.

| | |
|---|---|
| ***A63B 23/12*** | (2006.01) |
| ***A63B 22/20*** | (2006.01) |
| *A63B 21/055* | (2006.01) |

(52) U.S. Cl.

CPC ..... *A63B 21/0552* (2013.01); *A63B 23/1245* (2013.01)

USPC ..... 482/51; 482/70

(56) References Cited

U.S. PATENT DOCUMENTS

| | | | | | |
|---|---|---|---|---|---|
| 4,659,077 | A | | 4/1987 | Stropkay | |
| 4,867,443 | A | | 9/1989 | Jensen | |
| 4,960,276 | A | * | 10/1990 | Feuer et al. | 482/70 |
| 5,181,894 | A | * | 1/1993 | Shieng | 482/70 |
| 5,192,257 | A | * | 3/1993 | Panasewicz | 482/70 |
| 5,368,533 | A | * | 11/1994 | Feuer et al. | 482/70 |
| 5,443,433 | A | | 8/1995 | Krag | |
| 6,302,829 | B1 | | 10/2001 | Schmidt | |
| 6,514,180 | B1 | * | 2/2003 | Rawls | 482/70 |
| 2006/0287168 | A1 | * | 12/2006 | Nizam | 482/71 |

FOREIGN PATENT DOCUMENTS

| | | |
|---|---|---|
| EP | 0 591 729 | 4/1994 |
| JP | 624029 | 9/1994 |
| WO | WO 94/26357 | 11/1994 |
| WO | WO 2004/058363 | 7/2004 |

OTHER PUBLICATIONS

Partial Translation of: MYGIND, Praestationsevne og fysiologiske krav i langrend: en sammenlignende analyse af dansk og international langrendselite, 1994, pp. 1-3.

Sales Brochure for "A Multi Testing Ergometer Developed for Kayak-Canoing-Skiing. The Modest Multi Ergometer Model 2'nd Generation Is Elegantly Simple.", Willy Modest & Son Aps, Denmark, 1992.

* cited by examiner

TRAINING APPARATUS IMITATING CROSS-COUNTRY SKIING

CROSS-REFERENCE TO RELATED APPLICATIONS

This application is the U.S. National Phase of PCT/DK2009/050284 filed Oct. 29, 2009, which claims priority of Danish Patent Application PA 2008 01487 filed Oct. 29, 2008.

The present invention relates to an apparatus and a method for exercising the human body by imitating the pattern of movements in cross-country skiing.

BACKGROUND OF INVENTION

Cross-country skiing is one of the most physically demanding sports, however also a seasonal sport depending on snowy roads. Alternative training methods for improving the participant's physical condition are therefore necessary. The most common alternative training methods are performed outdoors but they are generally difficult to measure in terms of performance and due to e.g. weather conditions there are periods in the year when it is difficult to train outdoor. Commercially available and efficient indoor cross-country ski training machines and methods do not exist.

In the population in general there is a tendency towards increased obesity and inactivity. For many obesity develops in the upper body and the most common forms of exercise to get rid of the excess fat are running and fitness machines such as step machines, cross/ellipse trainers and rowing machines. However the range of exercise machines in fitness centres offers no possibility of effectively generating high energy consumption, increasing strength of and specifically improving the physical condition of the upper body.

SUMMARY OF INVENTION

Cross-country skiing training machines are known in the art, for example AT 387722 B, U.S. Pat. No. 4,867,443 and U.S. Pat. No. 5,443,433. The development within cross-country skiing is moving towards an increased use of the arms and upper body in the skiing motion with less focus on the legs. However, there is no commercially available effective indoor alternative to cross-country skiing that is able to improve both the physical fitness in general and specific strength of the upper body. One object of the invention is therefore to provide a solution which specifically can improve the upper body movement of cross-country skiing, however still addressing the general public within physical fitness. This is achieved by an apparatus for exercising the human body comprising:

- a stiff frame accommodating at least two guide tracks and at least one carriage in each guide track,
- at least one resistance unit, preferably attached to the frame, and
- for each carriage:
  - a substantially inelastic cord drive system connecting said carriage with said at least one resistance unit, and
  - an elastic cord drive system connecting the substantially inelastic cord drive system with the frame.

The invention further relates to a method for exercising the human body by engaging a resistance unit by means of repeatedly stroking one or both of two hand-held poles, each of said poles mounted on a carriage arranged in a guide track on a stiff frame, wherein

- the first part of a pole stroke translates the attached carriage backwards from a starting point on the guide track, thereby engaging the resistance unit by means of a substantially inelastic cord drive system attached to the carriage,
- the second and last part of a pole stroke automatically returns the carriage to the starting point by means of an elastic cord drive system connected to the frame,
- said substantially inelastic cord drive system and said elastic cord drive system connected to each other.

DETAILED DESCRIPTION OF THE INVENTION

Cross-country skiers typically use their own highly specialized and/or individualized ski poles. In the preferred embodiment of the invention each carriage comprises means for attaching a pole, such as a ski pole, such as a roller ski pole and/or a cross-country ski pole. Thereby a user can use his own ski poles in the preferred embodiment of the apparatus according to the invention. This fact can make the apparatus highly individualized and thereby attractive for cross-country skiing athletes. When using the training apparatus the carriages are moved back and forth in the guide tracks whereas a user of the apparatus substantially remains at the same position. The attachment means for securing a pole is preferably fixed to the carriage by means of a joint that allows free movement of the free end of an attached pole, e.g. by fixed by means of a ball joint or a joint with two axles. This provides the most flexibility and comfort for users of the training apparatus.

The substantially inelastic cord drive systems (or just inelastic cord drive systems), one for each carriage, are provided to engage the resistance unit. I.e. when a carriage is translated in a guide track the corresponding cord drive system will engage the resistance unit, preferably by means of a pulley system. A carriage can be translated in two directions in the corresponding guide track: backwards and forwards. Engagement of the resistance unit will only be provided in a translation in one of those two directions. In the following engagement of the resistance unit is provided when a carriage is translated in the corresponding guide track in the backwards direction. This is in line with a users experience when using the apparatus: the resistance unit is engaged when the one or both of the ski poles are pushed backwards from the user as in cross-country skiing. The starting point of this movement (and the starting point of a pole stroke) is defined to be the beginning of this backwards translation.

By the term "substantially inelastic cord drive system" is meant a cord drive system with a cord that is not flexible like a rubber band, however not totally stiff and inelastic like a steel wire. The inelasticity of the cord drive system ensures that most possible of the force that translates a carriage in the backwards direction is transferred to the resistance unit. A standard string, such as a nylon string, as used in sailing could be used in the inelastic cord drive systems of the training apparatus according to the invention, because a string would be sufficiently inelastic, however still suitable for use in a pulley system.

If a cross-country skiing situation should be completely imitated a user of the training apparatus according to the invention should pull the poles back to the starting point by own motion. However, in a real life cross-country skiing situation the weight of the ski poles are so minimal (possibly around 100 g each) that the return motion in a pole stroke only requires a minimal amount of work by the athlete. However, if the user of the training apparatus according to the invention were to return the poles by own motion he might meet resistance, such as friction, from the carriages in the guide tracks and the return movement itself might not be a natural movement for a cross-country skiing athlete. The far most important movement to train and practise is the backwards push of the ski poles. It is therefore the inventor's experience that the most efficient training is provided when the carriages are returned automatically to the starting point after a backwards translation in the guide tracks, i.e. the poles are returned automatically for the user of the training apparatus.

This automatic return is provided by means of the elastic cord drive systems, one for each carriage. Each inelastic cord drive system connects a carriage with the resistance unit. Each inelastic cord drive system is then connected to the frame by means of an elastic cord drive system. When a carriage is translated backwards the corresponding inelastic cord drive engages the resistance unit. This backwards translation causes tension to be applied to the corresponding elastic cord drive system. When the backwards translation is completed the tense elastic cord drive system will bring the corresponding carriage forward to the starting point. The travelling speed of this forward translation is depending on the tension and flexibility of the corresponding elastic cord drive system. In the preferred embodiment of the invention the flexibility and/or tension of at least one of the elastic cord drive systems is adjustable.

When connecting two cord drive systems that possibly are arranged on pulley systems, there is a great risk of internal twisting of the cord drive systems. In the preferred embodiment of the invention each substantially inelastic cord drive system is connected to one of the elastic cord drive systems by means of a turning joint. This turning joint allows the connected cord drive systems (i.e. the inelastic and the elastic cord drive systems) to rotate freely around their longitudinal axis in relation to each other.

The provision of an inelastic cord drive system and an elastic cord drive system for each carriage ensures that the carriages can be operated independently of each other. Thereby the resistance unit can be engaged by the carriages one at a time to imitate the "nordic style" of cross-country skiing. However, the resistance unit may also be engaged by translating both carriages backwards concurrently thereby imitating a double pole stroke.

In the preferred embodiment of the invention it is not necessary to fix the apparatus to the ground, because at least one foot plate is provided. The foot plate(s) is preferably attached to the frame for fixing the apparatus to the floor/ground solely by the combined weight of the apparatus and a user located on the foot plate. Preferably the underside of the foot plate(s) is level with the surface of the floor/ground. Preferably said at least one foot plate is adjustable along the longitudinal axis of the frame. This is to facilitate different standing positions for different users, in particular users of different heights.

When cross-country skiing in the terrain the resistance felt during a pole stroke is composed primarily by two components: Inertia from accelerating during the pole stroke and the drag resistance from the ski moving on the snow. The resistance unit is provided as the storage for the kinetic energy exerted by a user of the training apparatus. In the preferred embodiment the resistance unit comprises at least one ergometer. The resistance unit may comprise a rotary resistance, preferably mounted with the axis of rotation in the horizontal plane. The resistance unit may comprise at least one flywheel, fan, centrifugal fan and/or magnetic resistance. A flywheel provides resistance mostly due to the weight of said flywheel. However, a fan where the resistance is mostly provided from wind resistance may also be provided. In the preferred embodiment of the invention the resistance unit comprises at least one centrifugal fan. The rotary resistance may be mounted with the axis of rotation in the horizontal plane and substantially perpendicular to the guide tracks. However, to reduce the height of the apparatus a rotary resistance may also be mounted with the axis of rotation in the vertical plane. Practical experience has shown that the resistance provided by a centrifugal fan is most suitable for imitating the feeling of cross-country skiing. The weight of a fan is also considerably less than the weight of a flywheel making an apparatus equipped with a fan easier to handle, also in terms of disassembly, see further below. A further advantage of using a fan is that some of the airflow produced by the fan may be blown on the user for greater comfort during the exercising. In one embodiment of the invention a kayak ergometer, such as a Dansprint ergometer, is used as the resistance unit. Thus, a further aspect of the invention relates to the use of a kayak ergometer as the resistance unit in a cross-country training apparatus according to the invention. A resistance unit provided with a magnetic rotary resistance is a possible low-cost solution.

The inelastic cord drive systems and/or the elastic cord drive systems are preferably at least partly shielded. Thereby it is avoided that a user incidentally steps of the cord drive systems which could cause a mess if interfered with in motion. Shielding further avoids that sweat dripping of a user exercising on the training apparatus according to the invention interferes with the cord drive systems. Shielding may be provided by horizontal profiles along the frame of the apparatus, either in one or both sides of the frame or in a middle section of the frame.

In a further embodiment of the invention the frame constitutes a substantially elongate rectangle with the two long sides of the rectangular frame accommodating the guide tracks. Further, the frame preferably comprises a middle section/profile between the guide tracks, said section at least partly accommodating the inelastic cord drive systems and the elastic cord drive systems. A shielded middle section resembles the visual perception of cross-country skiing in a prepared snow track.

The width of the apparatus is provided to resemble the distance between the poles when cross-country skiing. However this width may vary from person to person, mostly depending on the size of the person. Thus, in a further embodiment of the invention the width of the apparatus is adjustable to further individualize the apparatus for different users. However, as the pole attachment means of the carriages are preferably mounted by means of a ball joint or double axle joint the adjustable width of the apparatus might not be highly necessary, because the poles can be moved freely in these joints.

In yet a further aspect of the invention each elastic cord drive system is mounted on a pulley system arranged along the longitudinal axis of the frame, said pulley system is preferably incorporated in the longitudinal middle section of the frame.

The apparatus is suitable for cardiovascular fitness training and/or muscular training of the upper body. An electronic display may be provided to monitor the time and/or power exerted in said at least one resistance unit.

Preferred uses of an apparatus according to the invention covers:

- imitating, resembling and/or simulating the body motion in cross-country skiing, and
- imitating, resembling and/or simulating the muscular and cardiovascular stimulation provided by cross-country skiing.

The preferred embodiment of the training apparatus according to the invention operates by means of two standard cross-country ski poles, each pole fixed to a carriage in a guide track system, such as a standard known linear guide track system. Preferably the two tracks are parallel, however a further embodiment of the invention comprises guide tracks that are not linear and/or not parallel.

When using the training apparatus a user translates the carriages backwards by applying force to one pole at a time or both poles simultaneously. The term backwards is used because this translation is a backwards translation seen from the user's point of view. After a backward translation is accomplished the carriages are preferably moved forward automatically, i.e. returned to the starting point. Preferably it is possible to adjust the return speed of travel of the carriages.

The training apparatus according to the invention is primarily designed to train the upper body but is considered by physiotherapists to provide a full body workout. In one embodiment of the invention the training apparatus can be disassembled into smaller sections without use of tools. Thereby the apparatus may be suitable for home use. The required space of the apparatus is already limited and with the option of easy assembling and disassembling the required space of the apparatus when not in use is further reduced. In most cases the training apparatus may fit under a bed when disassembled. Typically the resistance unit will be separated from the frame thereby disassembling the apparatus into two pieces. Compared to other commercially available indoor cardiovascular training machines for cycling, running, rowing or stepping, the required space of the training apparatus according to the invention is minimal. A further advantage for home use is that the training apparatus does not have to be fixed in location for use, i.e. preferably the apparatus is fixed to the ground solely by the combined weight of the user and the apparatus.

A carriage is coupled to a resistance unit which creates a known resistance to the travel of a pole attached to the carriage when it is moved in the backward direction. During use the user preferably places his feet between the two guide tracks on a foot plate which is mounted so that the user's weight holds the apparatus down on the floor. The user pushes the ski poles at least partly in the horizontal length of the guide tracks, mostly with the help of his upper body muscles. When the ski poles have reached the end of their travel, the user brings his arms forward and prepares for a repeat movement. The return travel mechanism provided by means of the elastic cord drive systems helps bring the ski poles to the starting point, so that the user can easily make many repetitions at a high frequency. The user can choose between moving the two poles in parallel or moving them diagonally (i.e. alternately). It is also possible to adjust the resistance provided by the resistance unit.

In summary the advantages of one embodiment of the present invention over the prior art are:

- The characteristics of this training apparatus are such that the poles are returned automatically to the user at a frequency corresponding to the frequency with which the user moves the skis.
- This apparatus allows the use of standard ski poles without any form of special tip.
- It is possible to divide the apparatus into smaller sections, such as two sections, without using tools and it is thus to easy to store and transport the apparatus according to the invention.
- The apparatus does not have to be permanently mounted at its place of installation.
- It is possible to provide accurate, electronic measurements of performance on the apparatus.

DRAWINGS

Figure 2:
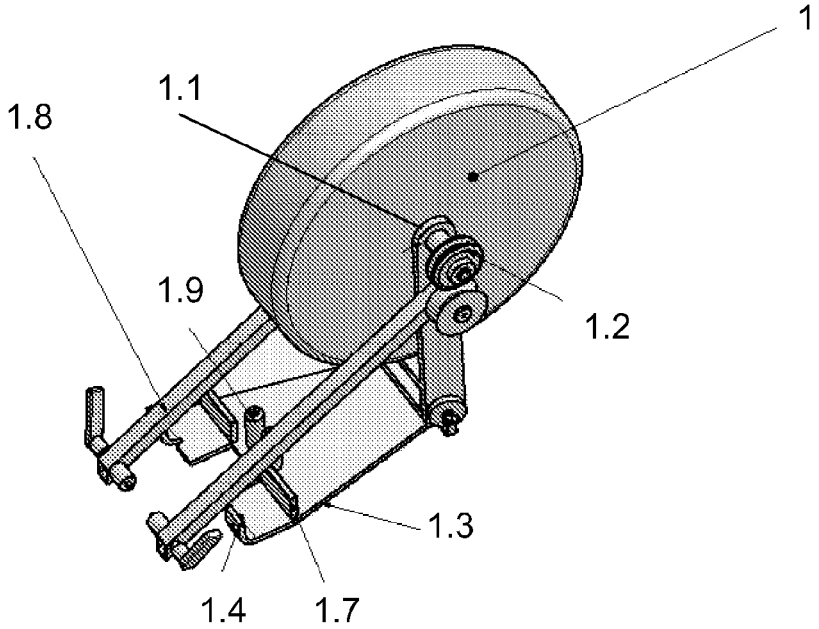
Figure 3:
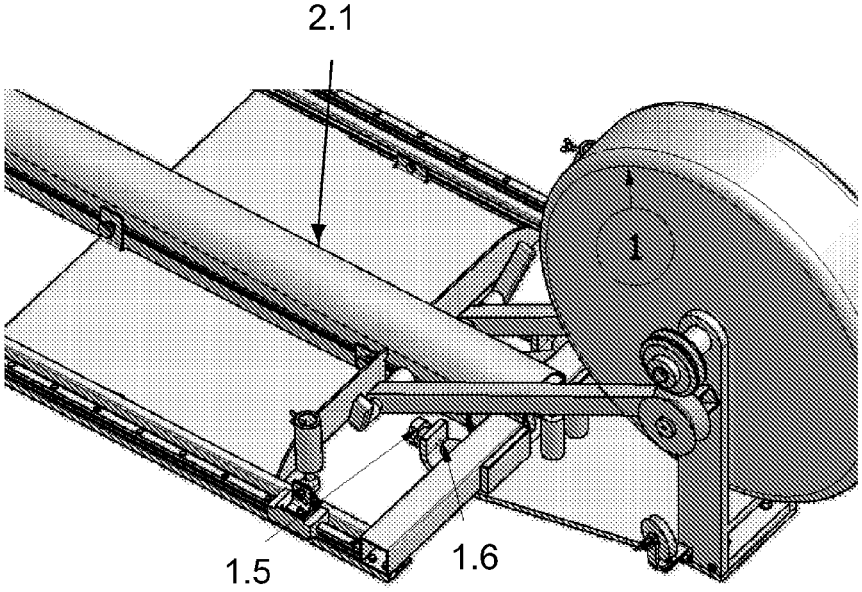
Figure 4:
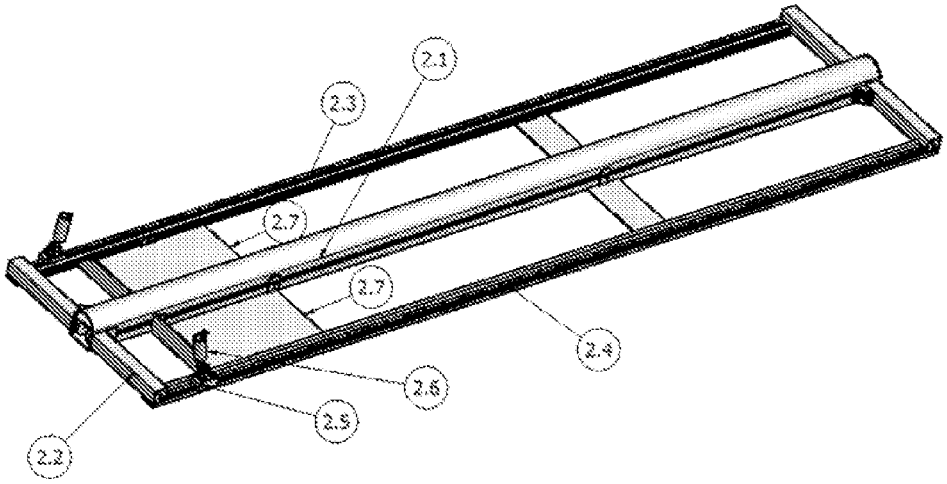
Figure 5:
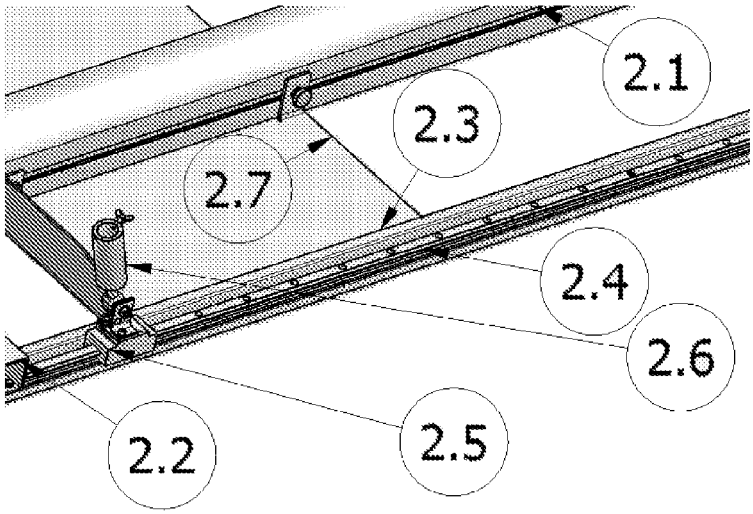
Figure 6:
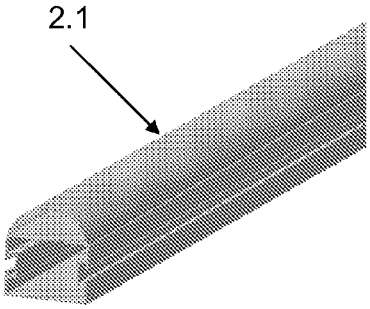
Figure 7:
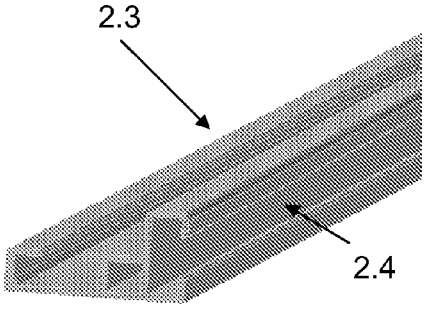
Figure 8A:
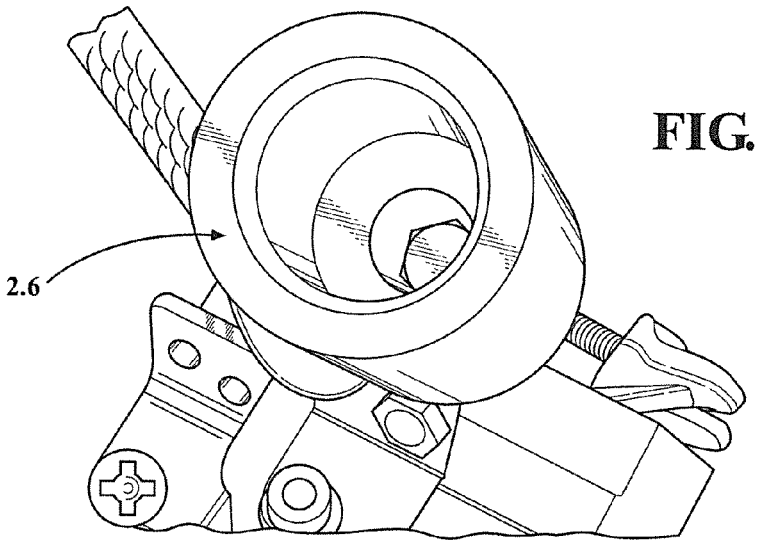
Figure 8B:
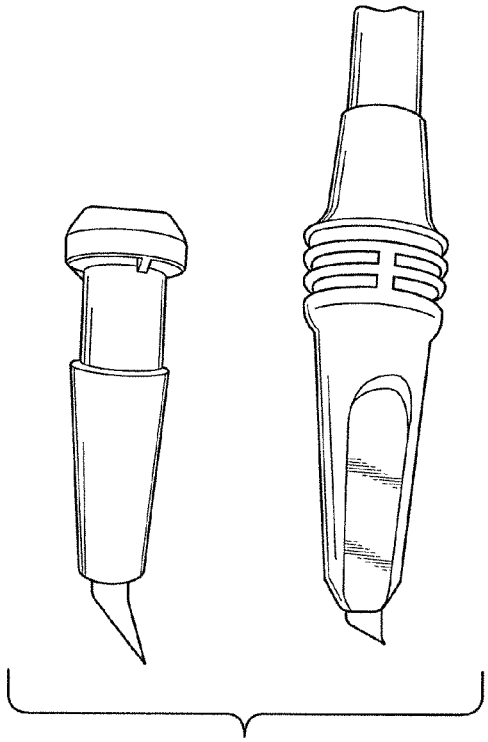
Figure 9A:
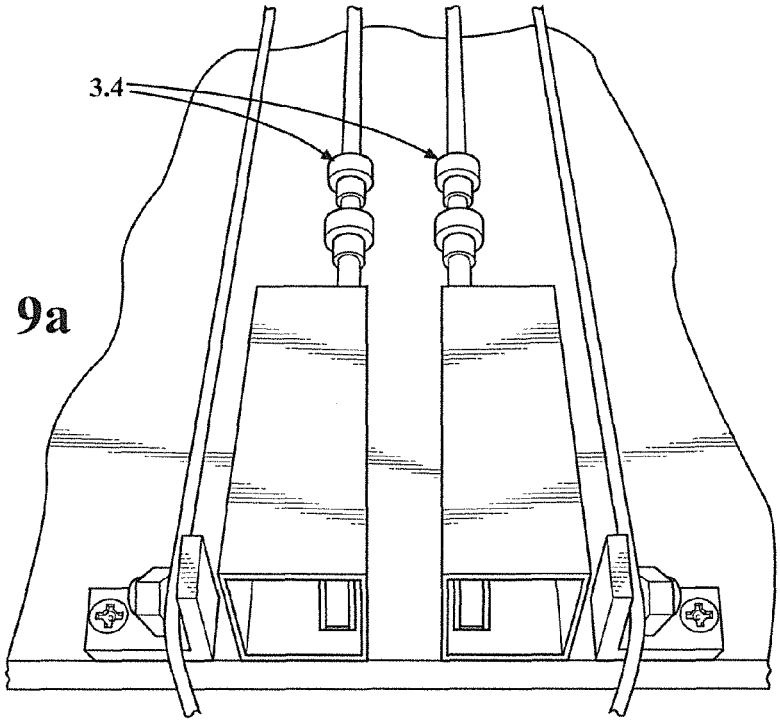
Figure 9B:
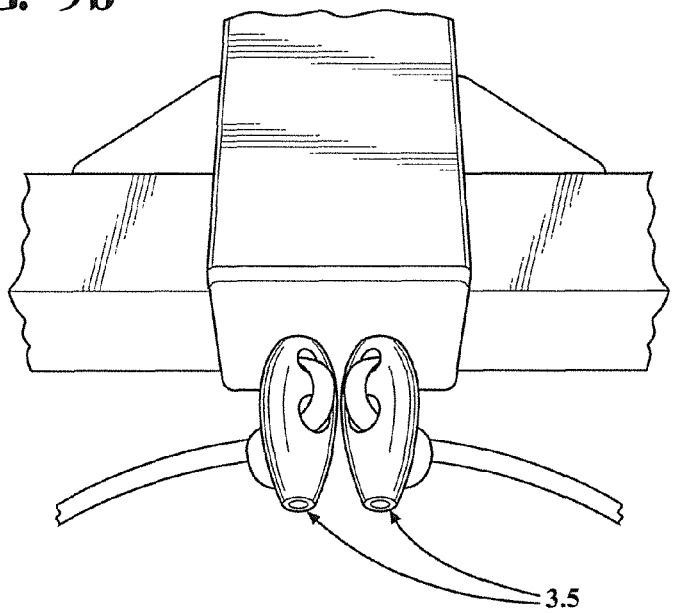
Figure 10:
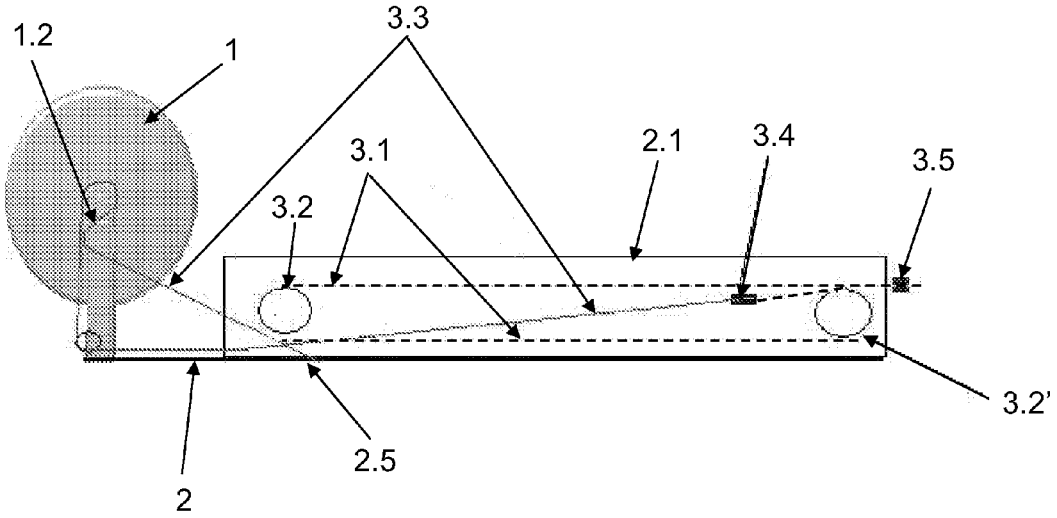
Figure 11:
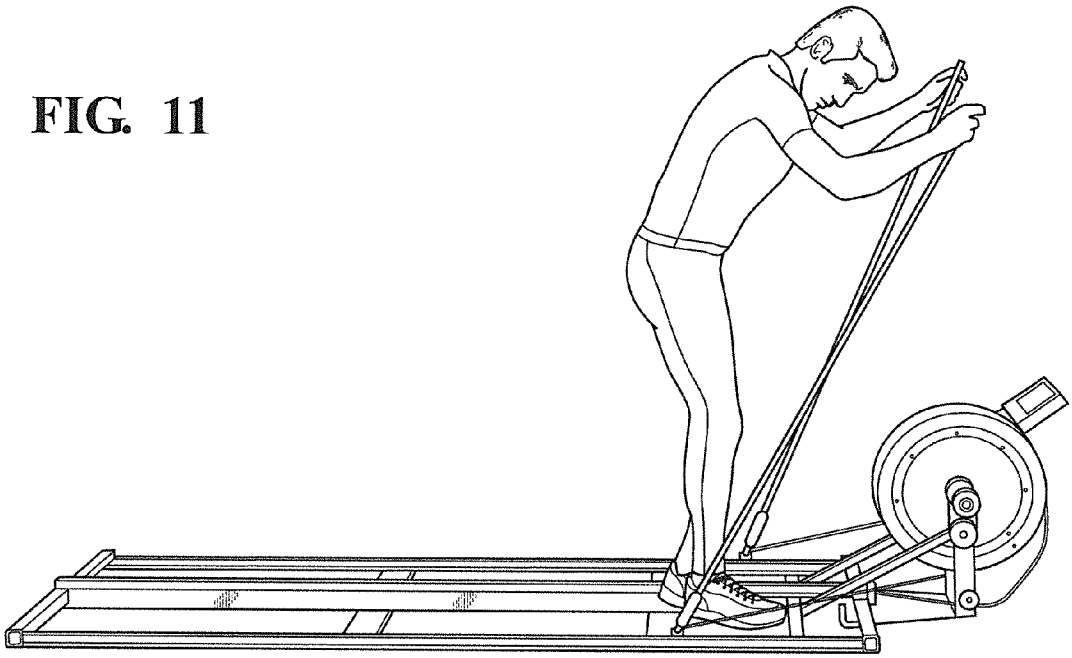
Figure 12:
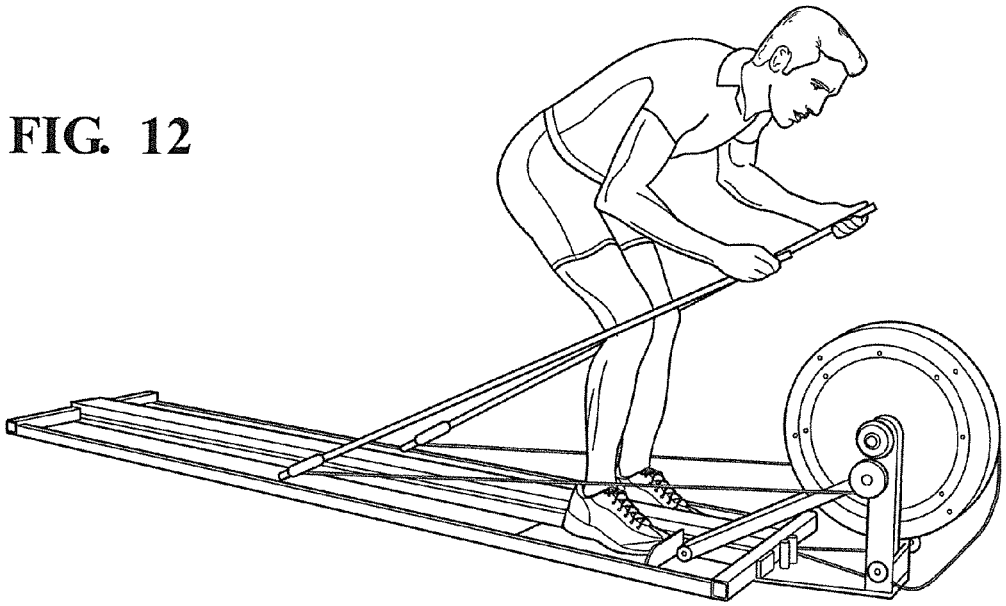

Various features and embodiments of the training apparatus according to the invention will now be described in greater detail with reference to the drawings in which FIG. 1 is a perspective illustrative view of a preferred embodiment of the invention, FIG. 2 is a perspective illustrative view of the resistance unit, FIG. 3 is a perspective view of the attachment between the resistance unit and the frame, FIG. 4 is a perspective illustrative view of the frame, FIG. 5 is a close up illustrative view of a pole carriage, FIG. 6 is an exemplary embodiment of a centre profile, FIG. 7 is an exemplary embodiment of a guide track profile, FIG. 8*a* is a close-up photo of a ski pole attachment, FIG. 8*b* shows the tip of two ski poles for roller skies, FIG. 9*a* is a picture of a turning joint between two strings, FIG. 9*b* is a picture of a cord retainer fixing the elastic cord system to the frame, FIG. 10 is an illustrative side view illustrating the combined cord and elastic pull, and FIGS. 11-12 show photos of cross-country skiers in different postures when using an embodiment of the invention.

DETAILED DESCRIPTION OF THE DRAWINGS

One embodiment of the training apparatus according to the invention comprises a resistance unit 1 and a frame 2 as seen in FIG. 1. An axle 1.1 can be acted on tangentially by two independent traction units 1.2 on each side of the resistance unit 1 as seen in FIG. 2. This tangential action causes rotation of the fan of the resistance unit 1.

A coupling plate 1.3 is fitted to the resistance unit at right angles and lies horizontally, with a cut-away fork 1.4 as seen in FIG. 2. The end of each prong of the fork is bent at substantially 90 degrees to vertical. The spacing between the prongs is dimensioned so that the centre profile 2.1 of the frame 2 fits into, and is supported by, the base on the same plane as the coupling plate 1.3. There is a threaded hole in the vertical section of the fork, where a compression-shoe bolt 1.5 is mounted as seen in FIG. 3. A compression shoe 1.6 is attached to the compression-shoe bolt 1.5. Two support plates are mounted 1.7 at right angles to the coupling plate 1.3 at the base of the fork 1.4.

The coupling between the frame 2 and the resistance unit 1 is composed as follows (see FIGS. 2, 3, 4 and 5): the centre profile 2.1 of the frame 2 is placed in the fork 1.4 on the coupling plate 1.3, the compression-shoe bolts 1.5 are tightened so that the attached compression shoe 1.6 presses the transverse profiles 2.2 of the frame against the support plates 1.7. One end of each of the two support rods 1.8 is fixed to the centre of the resistance unit 1, with the other end attached to the centre line 2.1 of the frame 2 to provide stability. An adjustment mechanism 1.9 is attached to the coupling plate 1.3 at the base of the fork 1.4, which guides the cords from the frame 2 across to the resistance unit 1. Thus, the resistance unit 1 may be mounted on the frame without use of special tools. An example of a centre profile is illustrated in FIG. 6.

The frame 2 comprises three longitudinal substantial parallel profiles whose ends are connected by transverse profiles 2.2, thus creating the frame 2 as seen in FIG. 4. A linear guide track system 2.4 of a standard type is attached to the two side profiles 2.3 which form the long sides of the frame 2. An example of a side profile is illustrated in FIG. 7. The carriages 2.5 in the guide track system are fitted with attachment means (holder) 2.6 (see FIG. 5) into which a pole can be inserted, a pole such as a conventional cross country ski pole or a conventional roller ski pole. This is illustrated in FIGS. 8*a* and 8*b*. The attachment means 2.6 is preferably mounted on the carriage by means of a ball joint or a double axle joint, thereby providing movement of the free end of an attached pole in all directions on half-sphere. The holder 2.6 for the pole can be designed so that a conventional ski pole fitted with a standard strap for use in roller skiing can be fitted and fixed directly to the holder. Substantially plane foot plates 2.7 are mounted between the centre profile 2.1 and the side profile 2.3, where the user places his feet when using the apparatus. The foot plates 2.7 are adjustable with respect to the longitudinal axis of the frame 2. The footplates 2.7 are mounted so that their horizontal base surface lies in the same plane as the horizontal base of the centre profile 2.1 and side profiles 2.3 of the frame 2.

Together one inelastic cord drive system and one elastic cord drive system may be seen as a combined cord and elastic pull system, with one combined system for each carriage. FIG. 10 is a distorted and simplified illustration of the combined cord and elastic pull system. Only one of the preferably two equivalent systems is illustrated in FIG. 10. The centre profile 2.1 has been "blown up" to more clearly illustrate the principle. The inelastic cord is marked by a solid line 3.3 and the elastic cord is marked by a dotted line 3.1. The inelastic cord 3.3 is fixed to carriage 2.5 and goes through traction unit 1.2 at resistance unit 1 and into the centre profile 2.1. The inelastic cord 3.3 is connected to the elastic cord 3.1 by means of turning joint (aka rotary connector) 3.4, which enables the inelastic cord and the flexible cord to rotate around their longitudinal axes in relation to each other. An example of a rotary connector 3.4 is shown in FIG. 9*a*. The elastic cord 3.1 then goes around pulley 3.2' and further around pulley 3.2 and further on to cord retainer 3.5 fixed to the frame 2. An example of a cord retainer 3.5 is shown in FIG. 9*b*. The pulleys 3.2, 3.2' may be of a standard type mounted near the ends (in the longitudinal direction) of the centre profile 2.1. At least a part of the elastic cord 3.1 stick out of the centre profile 2.1 for the user to be able to get hold of it when adjusting the tension of the elastic cord system. When the carriage 2.5 is translated backwards in a pole stroke (to the right in FIG. 10) the inelastic cord 3.3 engages the resistance unit 1 and pulls the turning joint 3.4 (to the left in FIG. 10). This pull increases the length of the elastic cord 3.1 thereby increasing the tension in the elastic cord 3.1. This tension will then exert a force on the carriage 2.5 and return said carriage 2.5 to the starting point. The flexible cord 3.1 in the elastic cord drive system could for example be a rubber band (aka elastic) or a string which is a combination of nylon and rubber. A diameter of the elastic cord and/or the inelastic cord of approx. 5 mm has proven to be suitable.

The flexible cord (aka elastic cord) is fixed to the frame 2 by means of a cord retainer 3.5. In the preferred embodiment of the invention the tension of the elastic cord system(s) is controlled by means of this cord retainer 3.5. E.g. by loosening this cord retainer 3.5 and pulling the flexible cord 3.1 (i.e. to the right in FIG. 10) the tension of the elastic cord 3.1 is increased. Thereby the return pull in the carriage 2.5 is increased during pole stroking and the carriage 2.5 will be returned to the starting point faster when using the training apparatus according to the invention. Equivalently the tension of the elastic cord system can be reduced by means of the cord retainer 3.5. This is an effective solution to adjust the return speed of the carriage and it is easily operable by a user. The return speed can be adjusted within seconds to individualize the training experience for a user.

The length and tension of the flexible cord 3.1 around the pulleys 3.2, 3.2' is such that it provides enough force to pull a carriage 2.5, with a pole attached to it, from one end of the track 2.4 to the other. The length of the flexible cord 3.1 is preferably approximately two times the length of the corresponding guide track, such as between 0.5 and 5 times the length of the corresponding guide track, such as between 1 and 4 times the length of the corresponding guide track, such as between 1.5 and 3 times the length of the corresponding guide track, such as between 1.8 and 2.3 times the length of the corresponding guide track. The length of the flexible cord 3.1 helps to ensure a suitable tension of the elastic cord system for automatic return of the carriage. When the length of the flexible cord 3.1 is e.g. approximately two times the length of the corresponding guide track the length of the flexible cord will be increased by approx. 50% in a pole stroke. If the length of the flexible cord 3.1 were e.g. approximately equal to the length of the corresponding guide track the length of the flexible cord will be increased by approx. 100% in a pole stroke. Thereby the tension of the elastic cord system will possibly be increased too much and the return speed of the carriage will be too high for resembling a natural cross-country situation.

FIGS. 11 and 12 show two different postures of cross-country athletes using the training apparatus according to the invention. One end of the ski pole is in the hand of the athlete, the other end is attached to a carriage. In FIG. 11 the carriages are substantially in the starting position for initiating a pole stroke. FIG. 12 shows an athlete during a double pole stroke.

In a further embodiment of the invention the resistance unit is an ergometer equipped with flywheel or a fan which can rotate around an axis. The power input of a user of the apparatus according to the invention can be calculated by measuring the rotational speed of the flywheel or fan. However, this power input is preferably calculated by measuring the breaking force acting on the flywheel or fan and monitoring the kinetic energy stored in the flywheel.

In an exemplary embodiment of the training apparatus according to the invention the frame is 2.48 m long, the guide tracks are 2.38 m long and the length of each flexible cord is approx. 5 m. The frame is mostly manufactured in a light metal such as aluminium. The guide tracks and carriages however preferably manufactured in stainless steel. The weight of the frame is approx. 15 kg and the weight of the resistance unit is approx. 17 kg.

The display may provide an output showing, numerically and/or graphically, one or more of the following parameters: Time, distance, power, speed, pole stroke rate, heart rate, right/left power balance, power vs. time, pacer and average and max/min values of the mentioned parameters. Further, the apparatus may be connected to a computer for output and storing and further processing of training data.

FURTHER DETAILS OF THE INVENTION

An exemplary embodiment of the invention relates to a training apparatus on which normal ski poles are used on tracks with an automatic and adjustable travel mechanism for the poles, to simulate the movements of the upper body in cross-country skiing. The training apparatus does not have to be permanently fixed in its installation location for use. The user's feet are static and help to ensure that the apparatus, with the additional weight of the user, is held firmly on the floor.

In a further embodiment a ski pole equipped with one of several standard strap types can be attached directly to the apparatus, so that a skier will be able to use his or her own ski poles from outdoor training on the apparatus.

Yet a further embodiment of the invention includes an electronic display of personal performance and makes it possible to see the pole's working time, power production in watts and estimated equivalent distance. The training apparatus is also characterised by its ability to be connected to a PC. This offers the possibility of establishing an internet connection and hence training and competition with others in cyberspace. With a connection to a PC it is also possible to analyse the performance on the apparatus.

In a further aspect of the invention a combined elastic and cord traction, which makes power transmission and a travel mechanism possible, in which the elastic and the cord are joined together with a special connection, which encourages the elastic and the cord to turn in relation to each other.

The invention claimed is:

1. An apparatus for exercising the human body by imitating the body motion in cross-country skiing comprising:

a stiff frame having at least two guide tracks and at least one carriage configured and operative to move backward and forward in each guide track, each carriage comprising an attachment for securing a pole, at least one resistance unit, attached to the frame, at least one foot plate attached to the frame and configured to support a user standing with his/her feet thereupon for fixing the apparatus to the floor/ground, the at least one foot plate and the feet of the user being stationary during exercise, the at least two guide tracks and respective at least one carriages being outboard of the at least one foot plate, and for each carriage:

a substantially inelastic cord drive system connecting said carriage with said at least one resistance unit and configured for engaging said at least one resistance unit when said carriage is moved backward in the guide track, and an elastic cord drive system connecting the substantially inelastic cord drive system with the frame and configured for pulling said carriage forward in the guide track;

wherein the apparatus is configured such that in use the feet of the user are passive on the at least one foot plate and such that in use the at least one resistance unit is only engaged by the user with one or both arms repeatedly stroking one or two poles attached to the attachment of the at least one carriage wherein the frame has a first end and an opposite second end and the at least two guide tracks extend along a longitudinal axis of the frame;

the at least one resistance unit is attached to the first end of the frame; and the elastic cord drive systems are generally horizontally integrated along the longitudinal axis of the frame extending generally from the first end to the opposite second end and arranged such that when a carriage is moved backwards in the guide track the corresponding elastic cord is elongated in the opposite forward direction.

2. The apparatus according to claim 1, wherein each substantially inelastic cord drive system is connected to one of the elastic cord drive systems by means of a turning joint.

3. The apparatus according to claim 1, wherein the length of the elastic cord in said elastic cord system(s) is between 1 and 4 times the length of the corresponding guide track.

4. The apparatus according to claim 1, wherein the flexibility of at least one of the elastic cord drive systems is adjustable.

5. The apparatus according to claim 1, wherein the attachment for securing a pole is fixed to the carriage by a joint that allows free movement of the free end of the pole.

6. The apparatus according to claim 1, wherein the resistance unit comprises a rotary resistance.

7. The apparatus according to claim 1, wherein the resistance unit comprises at least one flywheel, fan, centrifugal fan and/or magnetic resistance.

8. The apparatus according to claim 1, wherein the carriages can be operated independently and/or concurrently.

9. The apparatus according to claim 1, wherein said frame constitutes a substantially elongate rectangle with the two long sides of the rectangular frame accommodating the guide tracks.

10. The apparatus according to claim 1, wherein the inelastic cord systems and/or the elastic cord systems are at least partly shielded.

11. The apparatus according to claim 1, wherein the frame comprises a middle section/profile between the guide tracks, said section at least partly accommodating the inelastic cord drive systems and the elastic cord drive systems.

12. The apparatus according to claim 1, wherein each elastic cord drive system is mounted on a pulley system arranged along the longitudinal axis of the frame.

13. The apparatus according to claim 1, wherein the apparatus is suitable for cardiovascular fitness training and/or muscular training of the upper body.

14. The apparatus according to claim 1, further comprising at least one electronic display to monitor the time and/or power exerted in said at least one resistance unit.

15. The apparatus according to claim 1, wherein the guide tracks define the outermost side edges of the frame and the carriages are disposed at the outermost side edges.

16. The apparatus according to claim 1, wherein the guide tracks have a horizontal base, the horizontal base of the guide tracks and the underside of the at least one foot plate being disposed in a common plane.

17. The apparatus according to claim 1, wherein the at least one foot plate has an underside that is level with the surface of a ground or floor surface supporting the apparatus.

18. A method for exercising the human body by engaging a resistance unit by means of repeatedly stroking one or both of two hand-held ski poles, each of said ski poles mounted on a carriage arranged in a guide track on a stiff frame, wherein the apparatus is fixed to the floor/ground by the combined weight of the apparatus, at least one foot plate attached to the frame in between the carriages, wherein the apparatus is fixed to the floor/ground by a user standing with his/her feet on a foot plate attached to the stiff frame, and wherein the first part of a pole stroke translates the attached carriage backwards from a starting point on the guide track, thereby engaging the resistance unit by means of a substantially inelastic cord drive system attached to the carriage, the second and last part of a pole stroke automatically returns the carriage to the starting point by means of an elastic cord drive system connected between the substantially inelastic cord drive system and the frame, thereby imitating the pattern of movement in cross-country skiing, and the feet of the user are stationary during exercise.

19. The method according to claim 18, wherein each substantially inelastic cord drive system is connected to one of the elastic cord drive systems by a turning joint.

20. The method according to claim 18, whereby the return speed of a carriage is adjustable.

21. The method according to claim 18, whereby the pole stroking can be performed with one ski pole at a time and both ski poles concurrently.

22. The method according to claim 18, whereby each elastic cord drive system is arranged on a pulley system arranged along the longitudinal axis of the frame.

23. The method according to claim 18, whereby the human body exercising is cardiovascular fitness training and/or muscular training of the upper body.

24. The method according to claim 18, substantially providing the muscular and cardiovascular stimulation provided by cross-country skiing.

25. A method for exercising the human body by engaging a resistance unit by means of repeatedly stroking one or both of two hand-held ski poles, the method comprising:

providing an apparatus for exercising the human body by imitating the body motion in cross-country skiing comprising;

a stiff frame having at least two guide tracks and at least one carriage configured and operative to move backward and forward in each guide track, each carriage comprising an attachment for securing a pole, at least one resistance unit, attached to the frame, at least one foot plate attached to the frame and configured to support a user standing with his/her feet thereupon for fixing the apparatus to the floor/ground, and for each carriage:

a substantially inelastic cord drive system connecting said carriage with said at least one resistance unit and configured for engaging said at least one resistance unit when said carriage is moved backward in the guide track, and an elastic cord drive system connecting the substantially inelastic cord drive system with the frame and configured for pulling said carriage forward in the guide track, and wherein the first part of a pole stroke translates the attached carriage backwards from a starting point on the guide track, thereby engaging the resistance unit by means of a substantially inelastic cord drive system attached to the carriage, the second and last part of a pole stroke automatically returns the carriage to the starting point by means of an elastic cord drive system connected between the substantially inelastic cord drive system and the frame, thereby imitating the pattern of movement in cross-country skiing, and the feet of the user are stationary during exercise.

* * * * *